US011298571B2

(12) United States Patent
Yu et al.

(10) Patent No.: US 11,298,571 B2
(45) Date of Patent: Apr. 12, 2022

(54) PRESSURE REGULATOR ASSEMBLY AND BYPASS ASSEMBLY FOR A SELF-CONTAINED BREATHING APPARATUS

(71) Applicant: MSA (Suzhou) Safety Equipment R&D Co., Ltd., Suzhou (CN)

(72) Inventors: Longteng Yu, Suzhou (CN); Lida Zhu, Suzhou (CN); Carsten Christian Leuschner, Berlin (DE); Wolfgang Heinz Adolf Kirchner, Berlin (DE)

(73) Assignee: MSA (Suzhou) Safety Equipment R&D Co., Ltd., Suzhou (CN)

( * ) Notice: Subject to any disclaimer, the term of this patent is extended or adjusted under 35 U.S.C. 154(b) by 542 days.

(21) Appl. No.: 15/743,844

(22) PCT Filed: Jul. 6, 2016

(86) PCT No.: PCT/CN2016/088863
§ 371 (c)(1),
(2) Date: Jan. 11, 2018

(87) PCT Pub. No.: WO2017/008664
PCT Pub. Date: Jan. 19, 2017

(65) Prior Publication Data

US 2018/0200545 A1 Jul. 19, 2018

(30) Foreign Application Priority Data

Jul. 15, 2015 (CN) ..... 201510415469.6

(51) Int. Cl.
*A62B 9/02* (2006.01)
*A62B 7/04* (2006.01)
*B63C 11/22* (2006.01)

(52) U.S. Cl.
CPC ..... *A62B 9/025* (2013.01); *A62B 7/04* (2013.01); *B63C 11/2227* (2013.01)

(58) Field of Classification Search
CPC ..... A62B 9/025; A62B 9/022; A62B 9/06; A62B 9/00; A62B 9/02; A62B 9/027;
(Continued)

(56) References Cited

U.S. PATENT DOCUMENTS 3,744,526 A * 7/1973 MacNiel ..... B63C 11/2209 137/599.18
4,041,978 A * 8/1977 Leemann ..... B63C 11/2236 137/494
(Continued)

FOREIGN PATENT DOCUMENTS

CN 1809400 A 7/2006
CN 101516722 A 8/2009
(Continued)

*Primary Examiner* — Joseph D. Boecker
*Assistant Examiner* — Brian T Khong
(74) *Attorney, Agent, or Firm* — The Webb Law Firm

(57) ABSTRACT

A pressure regulator assembly for an SCBA includes a valve assembly having a piston, a cylinder for receiving the piston, a sealing member for engagement by the piston, a conduit extending through the piston and facilitating fluid communication between an inlet chamber and a cavity of the cylinder, and a driving assembly for facilitating the engagement and disengagement of the piston responsive to a change of pressure in the outlet chamber. A bypass assembly for an SCBA is also disclosed.

16 Claims, 3 Drawing Sheets

(58) Field of Classification Search
CPC .... A62B 7/04; A62B 7/02; A62B 7/00; B63C 11/2227; B63C 11/2236; B63C 11/2209; B63C 11/22; B63C 2011/2218
See application file for complete search history.

(56) References Cited

U.S. PATENT DOCUMENTS 4,094,314 A * 6/1978 Le Cornec ..... A62B 9/022 128/204.26
4,219,017 A * 8/1980 Shamlian ..... B63C 11/2209 128/204.26
4,224,938 A * 9/1980 Hilal ..... A62B 9/022 128/204.26
4,297,998 A * 11/1981 Christianson ..... A62B 9/027 128/204.26
4,437,460 A * 3/1984 Glynn ..... A62B 9/025 128/204.26
4,534,380 A * 8/1985 Ottestad ..... A62B 9/027 137/490
4,858,606 A * 8/1989 Hamlin ..... A62B 7/14 128/204.29
4,862,884 A * 9/1989 Christianson ..... B63C 11/18 128/204.26
4,887,591 A * 12/1989 Okumura ..... A62B 7/04 128/205.21
5,035,238 A * 7/1991 Christianson ..... B63C 11/18 128/204.26
5,097,860 A * 3/1992 Ferguson ..... B63C 11/2209 137/78.1
5,222,490 A * 6/1993 Pomerantz ..... B63C 11/2227 128/204.26
5,233,976 A * 8/1993 Ferguson ..... B63C 11/2227 128/200.24
5,251,618 A * 10/1993 Christianson ..... B63C 11/18 128/201.28
5,259,374 A * 11/1993 Miller ..... A62B 9/02 128/200.24
5,259,375 A * 11/1993 Schuler ..... A62B 9/02 128/204.26
5,357,950 A * 10/1994 Wippler ..... A62B 9/027 128/204.26
5,497,803 A * 3/1996 Ferrante ..... A62B 9/02 137/505.42
5,549,107 A * 8/1996 Garraffe ..... B63C 11/2227 128/204.26
5,660,502 A * 8/1997 Ferguson ..... B63C 11/2227 405/186
5,690,100 A * 11/1997 Pomerantz ..... A62B 9/02 128/204.26
5,810,041 A * 9/1998 Garofalo ..... B63C 11/2209 137/505.37
5,970,977 A * 10/1999 Sattelberg ..... A62B 9/025 128/204.26
6,155,258 A * 12/2000 Voege ..... A61M 16/00 128/205.21
7,296,780 B1 * 11/2007 Hung ..... B05B 1/3026 239/526
8,025,053 B1 9/2011 Prete et al.
8,459,263 B2 6/2013 Reynolds
8,857,431 B2 * 10/2014 Gillotin ..... A62B 9/022 128/204.26
2003/0189111 A1 * 10/2003 Heren ..... F16K 31/3855 239/570
2004/0149286 A1 * 8/2004 Haston ..... A62B 9/022 128/204.26
2004/0154669 A1 * 8/2004 Semeia ..... B63C 11/2227 137/505.46
2004/0261794 A1 * 12/2004 Patterson ..... A62B 9/022 128/204.26
2005/0279410 A1 * 12/2005 Angelini ..... B63C 11/2227 137/505.42
2007/0215829 A1 * 9/2007 Mau ..... F16K 31/52 251/186
2008/0110451 A1 * 5/2008 Dunsmore ..... A61M 16/00 128/200.14
2010/0236635 A1 * 9/2010 Tatarek ..... A62B 9/027 137/14
2012/0048274 A1 * 3/2012 Bayron ..... A61M 16/0833 128/205.14
2012/0115210 A1 * 5/2012 Winters ..... C12M 21/02 435/257.1
2013/0228240 A1 * 9/2013 Noceti ..... F16K 5/08 137/505.39
2014/0251333 A1 * 9/2014 Burk ..... A61M 16/0816 128/205.12

FOREIGN PATENT DOCUMENTS

CN 202107081 U 1/2012
EP 0269900 A1 6/1988
GB 2014047 A 8/1979
WO 2015030493 A1 3/2015

* cited by examiner

PRESSURE REGULATOR ASSEMBLY AND BYPASS ASSEMBLY FOR A SELF-CONTAINED BREATHING APPARATUS

CROSS REFERENCE TO RELATED APPLICATIONS

This application is the United States national phase of International Application No. PCT/CN2016/088863 filed Jul. 6, 2016, and claims priority to Chinese Application Serial No. 201510415469.6 filed Jul. 15, 2015, the entire contents of which are hereby incorporated by reference.

BACKGROUND OF THE INVENTION

Field of the Invention

This invention relates generally to a pressure regulator assembly for use with a mask or helmet, such as a breathing mask or helmet used in connection with a self-contained breathing apparatus.

Description of the Related Art

When working or moving around in certain hazardous environments, a person may often use a self-contained breathing apparatus (SCBA), which typically includes one or more compressed air tanks or cylinders fluidly connected to a breathing mask or helmet. For example, such SCBAs are often used in firefighting activities when the firefighter is engaged in activities in a smoky environment. Further, and since the air pressure in the compressed air tank or cylinder is relatively high, the pressure must first be reduced before introduction into the inner area of the breathing mask or helmet, so that the air is suitable for breathing. A SCBA normally includes a two-stage pressure reduction process through which the pressure of the output air from the compressed air tank or cylinder is regulated in stages to a desired breathing pressure.

Currently, positive pressure-type firefighting pressure regulator and mask assemblies, which use a positive pressure-type air supply valve, exhibit various drawbacks and deficiencies, including: (1) difficulty and complexity in assembly that often requires optimizing during and after assembly and prior to use in normal operation; (2) introduction of a valve chatter that often occurs when an air supply valve is in use, where such a chatter cannot be completely eliminated during the optimizing process; (3) a high breathing resistance and unstable pressure reduction, particularly in a low-temperature environment where leakage and breathing difficulty can have a high occurrence rate; and (4) high complexity in operation, bulky volume, and increased weight, such that these existing systems and assemblies require the use of two hands in cooperation to handle and operate.

There is a need in the art for improved pressure regulators and associated assemblies for use in connection with a breathing mask or helmet in a self-contained breathing apparatus.

SUMMARY OF THE INVENTION

Accordingly and generally, provided is an improved pressure regulator assembly for use in connection with a breathing mask or helmet in a self-contained breathing apparatus. Preferably, provided is an improved pressure regulator assembly that is durable, comfortable, and easy in assembly and operation. Preferably, provided is an improved regulator assembly that is useful in connection with a positive pressure-type air supply valve and system. Preferably, provided is an improved bypass assembly for use with a pressure regulator assembly in a self-contained breathing apparatus.

According to one preferred and non-limiting embodiment or aspect, provided is a pressure regulator assembly, comprising: a housing defining an inlet chamber in fluid communication with an outlet chamber; and a valve assembly positioned between the inlet chamber and the outlet chamber, the valve assembly comprising: (i) a piston having a body with a first end and a second end; (ii) a cylinder configured to receive the second end of the piston and defining a cavity between an end of the cylinder and the second end of the piston; (iii) a sealing member configured for engagement by the first end of the piston, wherein, when the first end of the piston engages the sealing member, air is prevented from exiting the inlet chamber, and when the first end of the piston is disengaged from the sealing member, air is capable of exiting the inlet chamber; and (iv) a conduit extending through the body of the piston and facilitating fluid communication between the inlet chamber and the cavity; and a driving assembly coupled to the valve assembly and configured to facilitate the engagement and disengagement of the piston responsive to a change of pressure in the outlet chamber.

In one preferred and non-limiting embodiment or aspect, the valve assembly further comprises at least one biasing element positioned in the cavity and configured to urge the first end of the piston into engagement with the sealing member. In another preferred and non-limiting embodiment or aspect, the at least one biasing element comprises at least one spring. In a further preferred and non-limiting embodiment or aspect, the second end of the piston comprises a recess configured to receive at least a portion of the at least one biasing element.

In one preferred and non-limiting embodiment or aspect, the valve assembly further comprises at least one passage at least partially enclosing the cylinder and an external surface of the first end of the piston to facilitate fluid communication between the inlet chamber and the outlet chamber when the first end of the piston is disengaged from the sealing member. In another preferred and non-limiting embodiment or aspect, the width of the passage is in the range of about 0.7 mm to about 1.2 mm, and a diameter of an inlet portion of the outlet chamber is in the range of about 8.8 mm to about 9.6 mm. In a further preferred and non-limiting embodiment or aspect, the width of the passage is about 1.0 mm and the diameter of the inlet portion of the outlet chamber is about 9.0 mm.

In one preferred and non-limiting embodiment or aspect, the inlet chamber extends in a first direction and the outlet chamber extends in a second direction, wherein the first direction is angled with respect to the second direction. In another preferred and non-limiting embodiment or aspect, the angle is about 90°.

In one preferred and non-limiting embodiment or aspect, the pressure regulator further comprises a bypass assembly configured to be removably attached to the pressure regulator assembly and configured to disengage the first end of the piston from the sealing member and facilitate the flow of air through the valve assembly and into the outlet chamber.

In one preferred and non-limiting embodiment or aspect, the bypass assembly comprises: a bypass housing defining a bypass inlet, a bypass outlet, and a fluid passage extending between the bypass inlet and the bypass outlet; and a push rod having a first end configured to contact the first end of the piston and disengage the first end of the piston from the sealing member, such that air in the fluid passage of the bypass housing flows through the valve assembly and into the outlet chamber. In another preferred and non-limiting embodiment or aspect, the pressure regulator assembly further comprises a rotatable member rotatably connected to the bypass housing, wherein when the rotatable member is rotated in a first direction, the push rod is urged toward and in contact with the first end of the piston to thereby disengage the first end of the piston and the sealing member, and wherein the rotatable member is rotated in a second direction, the push rod is urged away from and out of contact with the first end of the piston to thereby permit reengagement of the first end of the piston with the sealing member. In a further preferred and non-limiting embodiment or aspect, the rotatable member comprises: a recess extending into a body of the rotatable member; and a cover positioned at least partially within the recess and engaged with a second end of the push rod, such that when the rotatable member is rotated in the first direction, the cover, and thereby the push rod, is urged toward and into contact with the first end of the piston to thereby disengage the first end of the piston and the sealing member. In a still further preferred and non-limiting embodiment or aspect, the bypass assembly is adjustable to thereby adjust the amount of the flow of air through the bypass assembly, through the valve assembly, and into the outlet chamber.

In one preferred and non-limiting embodiment or aspect, provided is a bypass assembly for a pressure regulator assembly having: (i) a valve assembly positioned between an inlet chamber and an outlet chamber and including: a piston having a body with a first end and a second end; and a sealing member configured for engagement by the first end of the piston, wherein, when the first end of the piston engages the sealing member, air is prevented from exiting the inlet chamber, and when the first end of the piston is disengaged from the sealing member, air is capable of exiting the inlet chamber; and (ii) a driving assembly coupled to the valve assembly and configured to facilitate the engagement and disengagement of the piston responsive to a change of pressure in the outlet chamber, the bypass assembly configured to be removably attached to the pressure regulator assembly and configured to disengage the first end of the piston from the sealing member and facilitate the flow of air through the valve assembly and into the outlet chamber.

In one preferred and non-limiting embodiment or aspect, the bypass assembly comprises: a bypass housing defining a bypass inlet, a bypass outlet, and a fluid passage extending between the bypass inlet and the bypass outlet; and a push rod having a first end configured to contact the first end of the piston and disengage the first end of the piston from the sealing member, such that air in the fluid passage of the bypass housing flows through the valve assembly and into the outlet chamber. In another preferred and non-limiting embodiment or aspect, the bypass assembly further comprises a rotatable member rotatably connected to the bypass housing, wherein when the rotatable member is rotated in a first direction, the push rod is urged toward and in contact with the first end of the piston to thereby disengage the first end of the piston and the sealing member, and wherein the rotatable member is rotated in a second direction, the push rod is urged away from and out of contact with the first end of the piston to thereby permit reengagement of the first end of the piston with the sealing member. In a further preferred and non-limiting embodiment or aspect, the rotatable member comprises: a recess extending into a body of the rotatable member; and a cover positioned at least partially within the recess and engaged with a second end of the push rod, such that when the rotatable member is rotated in the first direction, the cover, and thereby the push rod, is urged toward and into contact with the first end of the piston to thereby disengage the first end of the piston and the sealing member.

In one preferred and non-limiting embodiment or aspect, the pressure regulator assembly further comprises: a cylinder configured to receive the second end of the piston and defining a cavity between an end of the cylinder and the second end of the piston; and a conduit extending through the body of the piston and facilitating fluid communication between the inlet chamber and the cavity.

In one preferred and non-limiting embodiment or aspect, provided is a self-contained breathing apparatus, comprising: at least one air cylinder configured to deliver regulated air through an air hose; and a breathing mask configured to be worn by a user, the breathing mask having a pressure regulator assembly configured to deliver air from the air hose to an internal area of the mask, wherein the pressure regulator assembly comprises: (a) a housing defining an inlet chamber in fluid communication with an outlet chamber; and (b) a valve assembly positioned between the inlet chamber and the outlet chamber, the valve assembly comprising: (i) a piston having a body with a first end and a second end; (ii) a cylinder configured to receive the second end of the piston and defining a cavity between an end of the cylinder and the second end of the piston; (iii) a sealing member configured for engagement by the first end of the piston, wherein, when the first end of the piston engages the sealing member, air is prevented from exiting the inlet chamber, and when the first end of the piston is disengaged from the sealing member, air is capable of exiting the inlet chamber; and (iv) a conduit extending through the body of the piston and facilitating fluid communication between the inlet chamber and the cavity; and (c) a driving assembly coupled to the valve assembly and configured to facilitate the engagement and disengagement of the piston responsive to a change of pressure in the outlet chamber.

In one preferred and non-limiting embodiment or aspect, provided is a pressure regulator assembly, comprising: an inlet and an outlet; a housing defining a first chamber in fluid communication with the inlet and a second chamber in fluid communication with the outlet; a valve assembly disposed between the first chamber and the second chamber, the valve assembly including: a piston having a first end and a second end opposite to the first end; a cylinder configured to receive the second end of the piston to define a cavity between the cylinder and the second end of the piston; and a sealing element disposed adjacent to the first end of the piston; wherein the piston has a through-hole disposed thereon to communicate the first end and the second end of the piston so as to allow fluid in the first chamber to flow into the cavity via the through-hole; and a driving assembly coupled to the valve assembly and configured to drive the piston to engage with the sealing element or move away from the sealing element in response to change of pressure in the second chamber.

In one preferred and non-limiting embodiment or aspect, the valve assembly further comprises a biasing element disposed within the cavity and configured to bias the piston towards the sealing element. In another preferred and non-limiting embodiment or aspect, the second end of the piston has a recess to receive at least a part of the biasing element.

In one preferred and non-limiting embodiment or aspect, the valve assembly further comprises a passage at least partially enclosing the cylinder and an external surface of the first end of the piston to allow fluid from the inlet to flow into the first chamber, then flow into the second chamber through the passage and reach the outlet when the piston is driven to move away from the sealing element. In another preferred and non-limiting embodiment or aspect, a size of the passage is in the range of 0.7 mm to 1.2 mm, and a diameter of the second chamber is in the range of 8.8 mm to 9.6 mm. In a further preferred and non-limiting embodiment or aspect, the size of the passage is 1.0 mm, and the diameter of the second chamber is 9.0 mm.

In one preferred and non-limiting embodiment or aspect, the first chamber is disposed along a fluid-in direction, the second chamber is disposed along a fluid-out direction, the fluid-in direction being angled with the fluid-out direction. In another preferred and non-limiting embodiment or aspect, the fluid-in direction is perpendicular to the fluid-out direction.

In one preferred and non-limiting embodiment or aspect, the pressure regulator assembly further comprises a bypass device coupled to the pressure regulator assembly, the bypass device comprising: a bypass housing defining a bypass inlet, a bypass outlet and a fluid passage between the bypass inlet and the bypass outlet; and a push rod, a first end of which is disposed adjacent the piston and configured to drive the piston to move away from the sealing element so as to fluidly communicate the fluid passage and the pressure regulator assembly.

In one preferred and non-limiting embodiment or aspect, the bypass device further comprises: a handwheel operatively coupled to the bypass housing and having a concave portion; and a cover received within the concave portion; wherein a second end of the push rod extends through the housing and is fixedly connected to the cover such that the push rod could move towards the piston or move away from the piston by adjusting the handwheel.

Further embodiments or aspects will now be described in the following numbered clauses.

Clause 1. A pressure regulator assembly, comprising: a housing defining an inlet chamber in fluid communication with an outlet chamber; a valve assembly positioned between the inlet chamber and the outlet chamber, the valve assembly comprising: (i) a piston having a body with a first end and a second end; (ii) a cylinder configured to receive the second end of the piston and defining a cavity between an end of the cylinder and the second end of the piston; (iii) a sealing member configured for engagement by the first end of the piston, wherein, when the first end of the piston engages the sealing member, air is prevented from exiting the inlet chamber, and when the first end of the piston is disengaged from the sealing member, air is capable of exiting the inlet chamber; and (iv) a conduit extending through the body of the piston and facilitating fluid communication between the inlet chamber and the cavity; and a driving assembly coupled to the valve assembly and configured to facilitate the engagement and disengagement of the piston responsive to a change of pressure in the outlet chamber.

Clause 2. The pressure regulator assembly of clause 1, wherein the valve assembly further comprises at least one biasing element positioned in the cavity and configured to urge the first end of the piston into engagement with the sealing member.

Clause 3. The pressure regulator assembly of clause 1 or 2, wherein the at least one biasing element comprises at least one spring.

Clause 4. The pressure regulator assembly of any of clauses 1-3, wherein the second end of the piston comprises a recess configured to receive at least a portion of the at least one biasing element.

Clause 5. The pressure regulator assembly of any of clauses 1-4, wherein the valve assembly further comprises at least one passage at least partially enclosing the cylinder and an external surface of the first end of the piston to facilitate fluid communication between the inlet chamber and the outlet chamber when the first end of the piston is disengaged from the sealing member.

Clause 6. The pressure regulator assembly of any of clauses 1-5, wherein a width of the passage is in the range of about 0.7 mm to about 1.2 mm, and a diameter of an inlet portion of the outlet chamber is in the range of about 8.8 mm to about 9.6 mm.

Clause 7. The pressure regulator assembly of any of clauses 1-6, wherein the width of the passage is about 1.0 mm and the diameter of the inlet portion of the outlet chamber is about 9.0 mm.

Clause 8. The pressure regulator assembly of any of clauses 1-7, wherein the inlet chamber extends in a first direction and the outlet chamber extends in a second direction, wherein the first direction is angled with respect to the second direction.

Clause 9. The pressure regulator assembly of any of clauses 1-8, wherein the angle is about 90°.

Clause 10. The pressure regulator assembly of any of clauses 1-9, further comprising a bypass assembly configured to be removably attached to the pressure regulator assembly and configured to disengage the first end of the piston from the sealing member and facilitate the flow of air through the valve assembly and into the outlet chamber.

Clause 11. The pressure regulator assembly of any of clauses 1-10, wherein the bypass assembly comprises: a bypass housing defining a bypass inlet, a bypass outlet, and a fluid passage extending between the bypass inlet and the bypass outlet; and a push rod having a first end configured to contact the first end of the piston and disengage the first end of the piston from the sealing member, such that air in the fluid passage of the bypass housing flows through the valve assembly and into the outlet chamber.

Clause 12. The pressure regulator assembly of any of clauses 1-11, further comprising a rotatable member rotatably connected to the bypass housing, wherein when the rotatable member is rotated in a first direction, the push rod is urged toward and in contact with the first end of the piston to thereby disengage the first end of the piston and the sealing member, and wherein the rotatable member is rotated in a second direction, the push rod is urged away from and out of contact with the first end of the piston to thereby permit reengagement of the first end of the piston with the sealing member.

Clause 13. The pressure regulator assembly of any of clauses 1-12, wherein the rotatable member comprises: a recess extending into a body of the rotatable member; and a cover positioned at least partially within the recess and engaged with a second end of the push rod, such that when the rotatable member is rotated in the first direction, the cover, and thereby the push rod, is urged toward and into contact with the first end of the piston to thereby disengage the first end of the piston and the sealing member.

Clause 14. The pressure regulator assembly of any of clauses 1-13, wherein the bypass assembly is adjustable to thereby adjust the amount of the flow of air through the bypass assembly, through the valve assembly, and into the outlet chamber.

Clause 15. A bypass assembly for a pressure regulator assembly having: (i) a valve assembly positioned between an inlet chamber and an outlet chamber and including: a piston having a body with a first end and a second end; and a sealing member configured for engagement by the first end of the piston, wherein, when the first end of the piston engages the sealing member, air is prevented from exiting the inlet chamber, and when the first end of the piston is disengaged from the sealing member, air is capable of exiting the inlet chamber; and (ii) a driving assembly coupled to the valve assembly and configured to facilitate the engagement and disengagement of the piston responsive to a change of pressure in the outlet chamber, the bypass assembly configured to be removably attached to the pressure regulator assembly and configured to disengage the first end of the piston from the sealing member and facilitate the flow of air through the valve assembly and into the outlet chamber.

Clause 16. The bypass assembly of clause 15, comprising: a bypass housing defining a bypass inlet, a bypass outlet, and a fluid passage extending between the bypass inlet and the bypass outlet; and a push rod having a first end configured to contact the first end of the piston and disengage the first end of the piston from the sealing member, such that air in the fluid passage of the bypass housing flows through the valve assembly and into the outlet chamber.

Clause 17. The bypass assembly of clause 15 or 16, further comprising a rotatable member rotatably connected to the bypass housing, wherein when the rotatable member is rotated in a first direction, the push rod is urged toward and in contact with the first end of the piston to thereby disengage the first end of the piston and the sealing member, and wherein when the rotatable member is rotated in a second direction, the push rod is urged away from and out of contact with the first end of the piston to thereby permit reengagement of the first end of the piston with the sealing member.

Clause 18. The bypass assembly of any of clauses 15-17, wherein the rotatable member comprises: a recess extending into a body of the rotatable member; and a cover positioned at least partially within the recess and engaged with a second end of the push rod, such that when the rotatable member is rotated in the first direction, the cover, and thereby the push rod, is urged toward and into contact with the first end of the piston to thereby disengage the first end of the piston and the sealing member.

Clause 19. The bypass assembly of any of clauses 15-18, wherein the pressure regulator assembly further comprises: a cylinder configured to receive the second end of the piston and defining a cavity between an end of the cylinder and the second end of the piston; and a conduit extending through the body of the piston and facilitating fluid communication between the inlet chamber and the cavity.

Clause 20. A self-contained breathing apparatus, comprising: at least one air cylinder configured to deliver regulated air through an air hose; and a breathing mask configured to be worn by a user, the breathing mask having a pressure regulator assembly configured to deliver air from the air hose to an internal area of the mask, wherein the pressure regulator assembly comprises: (a) a housing defining an inlet chamber in fluid communication with an outlet chamber; (b) a valve assembly positioned between the inlet chamber and the outlet chamber, the valve assembly comprising: (i) a piston having a body with a first end and a second end; (ii) a cylinder configured to receive the second end of the piston and defining a cavity between an end of the cylinder and the second end of the piston; (iii) a sealing member configured for engagement by the first end of the piston, wherein, when the first end of the piston engages the sealing member, air is prevented from exiting the inlet chamber, and when the first end of the piston is disengaged from the sealing member, air is capable of exiting the inlet chamber; and (iv) a conduit extending through the body of the piston and facilitating fluid communication between the inlet chamber and the cavity; and (c) a driving assembly coupled to the valve assembly and configured to facilitate the engagement and disengagement of the piston responsive to a change of pressure in the outlet chamber.

Clause 21. A pressure regulator assembly, comprising: an inlet and an outlet; a housing defining a first chamber in fluid communication with the inlet and a second chamber in fluid communication with the outlet; a valve assembly disposed between the first chamber and the second chamber, the valve assembly including: a piston having a first end and a second end opposite to the first end; a cylinder configured to receive the second end of the piston to define a cavity between the cylinder and the second end of the piston; and a sealing element disposed adjacent to the first end of the piston; wherein the piston has a through-hole disposed thereon to communicate the first end and the second end of the piston so as to allow fluid in the first chamber to flow into the cavity via the through-hole; and a driving assembly coupled to the valve assembly and configured to drive the piston to engage with the sealing element or move away from the sealing element in response to change of pressure in the second chamber.

Clause 22. The pressure regulator assembly according to clause 21, wherein the valve assembly further comprises a biasing element disposed within the cavity and configured to bias the piston towards the sealing element.

Clause 23. The pressure regulator assembly according to clause 21 or 22, wherein the second end of the piston has a recess to receive at least a part of the biasing element.

Clause 24. The pressure regulator assembly according to any of clauses 21-23, wherein the valve assembly further comprises a passage at least partially enclosing the cylinder and an external surface of the first end of the piston to allow fluid from the inlet to flow into the first chamber, then flow into the second chamber through the passage and reach the outlet when the piston is driven to move away from the sealing element.

Clause 25. The pressure regulator assembly according to any of clauses 21-24, wherein a size of the passage is in the range of 0.7 mm to 1.2 mm, and a diameter of the second chamber is in the range of 8.8 mm to 9.6 mm.

Clause 26. The pressure regulator assembly according to any of clauses 21-25, wherein the size of the passage is 1.0 mm, and the diameter of the second chamber is 9.0 mm.

Clause 27. The pressure regulator assembly according to any of clauses 21-26, wherein the first chamber is disposed along a fluid-in direction, the second chamber is disposed along a fluid-out direction, the fluid-in direction being angled with the fluid-out direction.

Clause 28. The pressure regulator assembly according to any of clauses 21-27, wherein the fluid-in direction is perpendicular to the fluid-out direction.

Clause 29. The pressure regulator assembly according to any of clauses 21-28, further comprising a bypass device coupled to the pressure regulator assembly, the bypass device comprising: a bypass housing defining a bypass inlet, a bypass outlet and a fluid passage between the bypass inlet and the bypass outlet; and a push rod, a first end of which is disposed adjacent the piston and configured to drive the piston to move away from the sealing element so as to fluidly communicate the fluid passage and the pressure regulator assembly.

Clause 30. The pressure regulator assembly according to any of clauses 21-29, wherein the bypass device further comprises: a handwheel operatively coupled to the bypass housing and having a concave portion; and a cover received within the concave portion; wherein a second end of the push rod extends through the housing and is fixedly connected to the cover such that the push rod could move towards the piston or move away from the piston by adjusting the handwheel.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various Figs. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise. Preferred features will be elucidated in the claims and in the specific description of the embodiments that follow. It will be readily appreciated that preferred features of certain aspects or embodiments could be usefully incorporated in other described embodiments even if not specifically described in those terms herein.

DETAILED DESCRIPTION OF THE INVENTION

Figure 1:
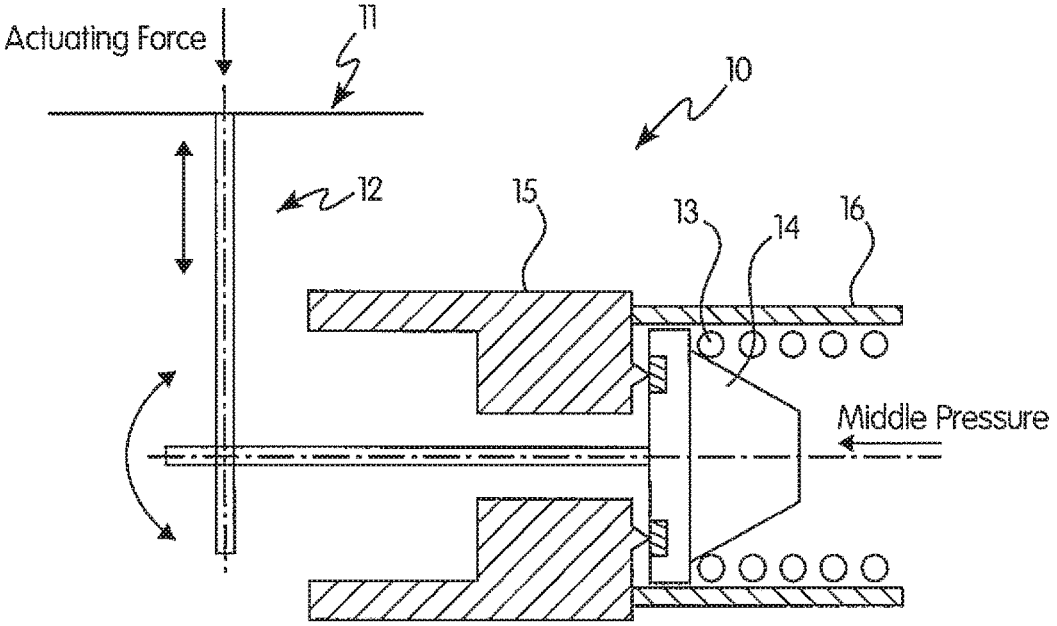
FIG. 1 (Prior Art)
FIG. 1 is a schematic view of an existing pressure regulator assembly according to the prior art.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing Figs. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

As illustrated in certain preferred and non-limiting embodiments or aspects in FIGS. 1-6, the present invention is directed to a pressure regulator assembly 100 and a bypass assembly 120 for a pressure regulator assembly for use with a self-contained breathing apparatus (SCBA). As illustrated in schematic form in FIG. 6, the self-contained breathing apparatus (SCBA) includes at least one air cylinder (AC) configured or operable to deliver regulated air through an air hose (not shown) and a breathing mask or helmet (M) configured to be worn by a user. Further, the breathing mask or helmet (M) includes a pressure regulator assembly (such as the existing pressure regulator assembly illustrated in FIG. 1 or the pressure regulator assembly 100 according to the principles of the present invention) configured to deliver air from the air hose to an internal area (IA) of the breathing mask or helmet (M).

FIG. 1 is a schematic diagram of an existing air supply valve assembly 10 in a pressure regulator for use in a self-contained breathing apparatus. As illustrated, the valve assembly 10 includes a diaphragm 11, a lever 12, a reset spring 13, a piston 14, a valve seat 15, and a cylinder 16, wherein the diaphragm 11 drives the piston 14 via the lever 12. When an actuating force is applied to the lever 12 via the diaphragm 11, the lever 12 will urge or push the piston 14 to disengage the valve seat 15, thereby opening the valve assembly to form a fluid passage (and deliver air to the breathing mask or helmet). However, since middle-pressure air exists in the cylinder 16, i.e., the pressure in a pressure chamber fully acts on the piston 14 during operation (e.g., when a conduit size of the cylinder is 6 mm, and under a 7 bar barometer condition, a piston with a diameter of 6 mm has to withstand a force exceeding 20 N)), and the reset spring 13 disposed in the cylinder 16 is present, the lever 12 needs a higher actuating force to urge or push the piston 14 to move and disengage. Therefore, this traditional (non-balanced) structured air supply valve assembly in FIG. 1 is relatively difficult to open or operate, which causes a greater breathing resistance, such that the parts are more easily worn out, which lowers the service life of the pressure regulator assembly.

Figure 2:
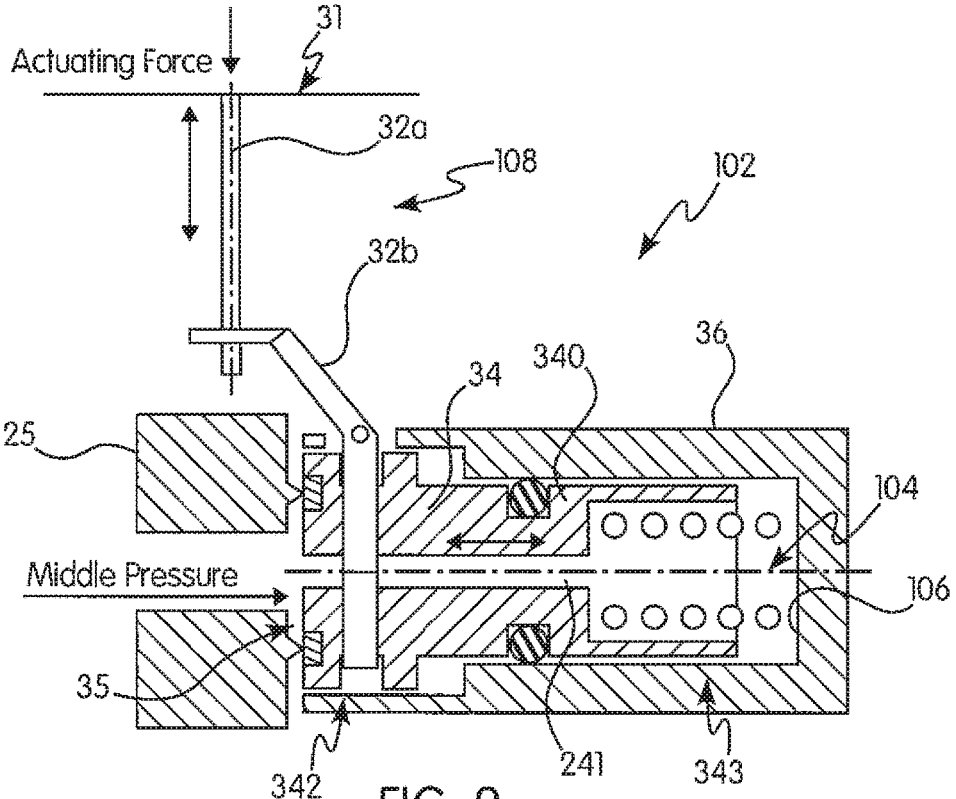
FIG. 2 is a schematic view of one embodiment or aspect of a pressure regulator assembly according to the principles of the present invention.

One preferred and non-limiting embodiment of a valve assembly 102 for the pressure regulator assembly 100 is illustrated in schematic form in FIG. 2. As discussed hereinafter, the pressure regulator assembly 100 according to the present invention includes a balanced valve assembly 102, wherein the valve assembly 102 facilitates the controlled passage of air through the pressure regulator assembly 100.

With reference to FIG. 2, and in one preferred and non-limiting embodiment or aspect (and as illustrated in schematic form), the valve assembly 102 includes: (i) a piston 34 having a body 340 with a first end 342 and a second end 343 opposite the first end 342; (ii) a cylinder 36 configured to receive the second end 343 of the piston 34 and defining a cavity 104 between an end 106 of the cylinder 36 and the second end 343 of the piston 34; (iii) a sealing member (or element) 35 configured for engagement by the first end 342 of the piston 34; and (iv) a conduit 241 (or through-hole) extending through the body 340 of the piston 34 and facilitating or providing fluid communication between an air inlet and the cavity 104. In addition, the pressure regulator assembly 100 includes a driving assembly 108 coupled to or operatively associated with the piston 34 and configured to facilitate or cause the engagement and/or disengagement of the piston 34 responsive to a change of pressure in an air outlet of the pressure regulator assembly 100. As illustrated in one preferred and non-limiting embodiment or aspect in FIG. 2, the drive assembly 100 may include a diaphragm 31, which, when acted on by an actuating force (or pressure) causes the driving assembly 108 (such as a first lever 32*a* and a second lever 32*b*) to disengage the first end 342 of the piston 34 from a sealing member 25. This operation, in turn opens the valve assembly 102 to form a fluid passage between an air inlet to an air outlet.

With comparison to the existing air supply valve assembly illustrated in FIG. 1, the conduit 241 provides fluid communication of air between the area (e.g., a middle-pressure chamber or area) in front of the piston 34 and the cavity 104 formed at the rear of the piston 34. Since both of the ends or areas of the piston 34 are in fluid communication with each other, the air outside of the cylinder 36 can flow into the cavity 104 of the cylinder 36 through the conduit 241. Accordingly, and since the middle-pressure air pressure exists in surfaces or areas of both sides of the piston 34, the acting forces generated by the air pressures at the front and rear sides of the piston 34 counteract during operation of the pressure regulator assembly 100, such that the air pressure acting on the piston 34 is close to zero. In this manner, the movement resistance of the piston 34 is highly minimized or reduced, which leads to minimization or elimination of wear and/or damage to the various parts and components of the pressure regulator assembly 100 and/or the valve assembly 102 (and thereby prolongs the service life of the pressure regulator assembly 100 and/or the valve assembly 102).

Figure 3:
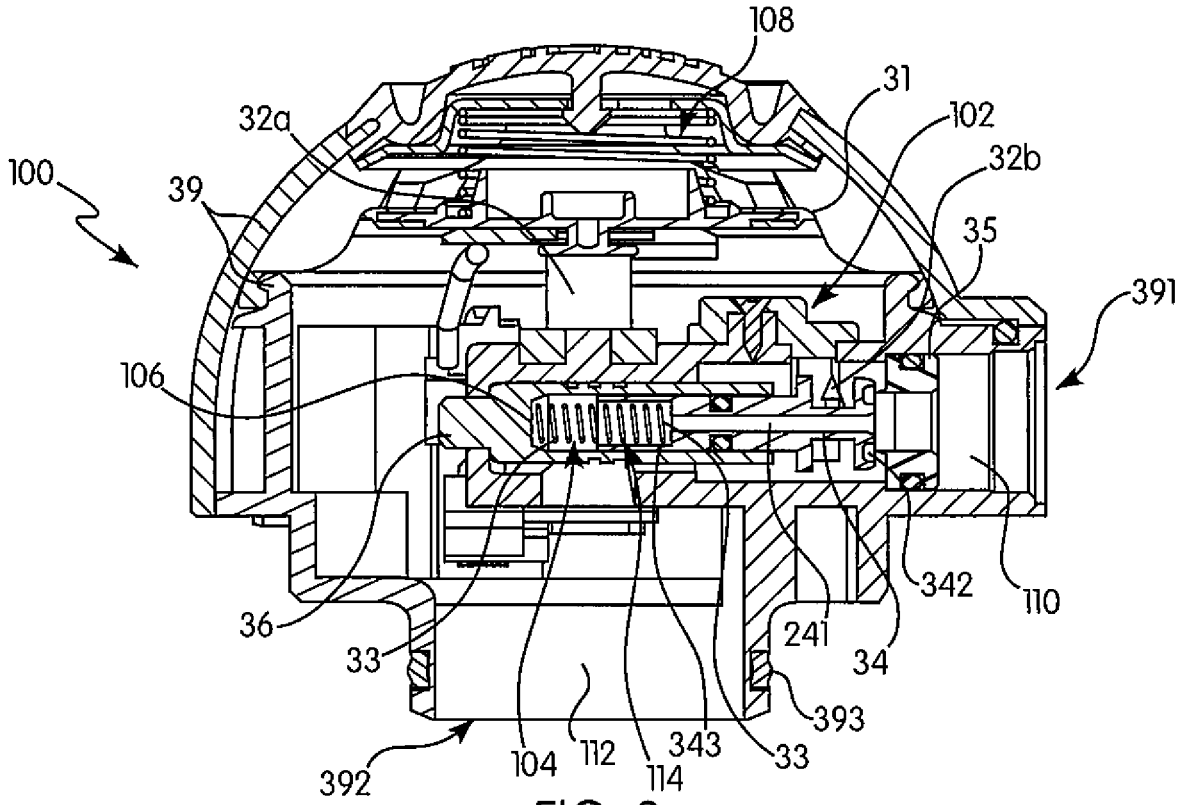
FIG. 3 is a cross sectional view of one embodiment or aspect of a pressure regulator assembly according to the principles of the present invention.
Figure 4:
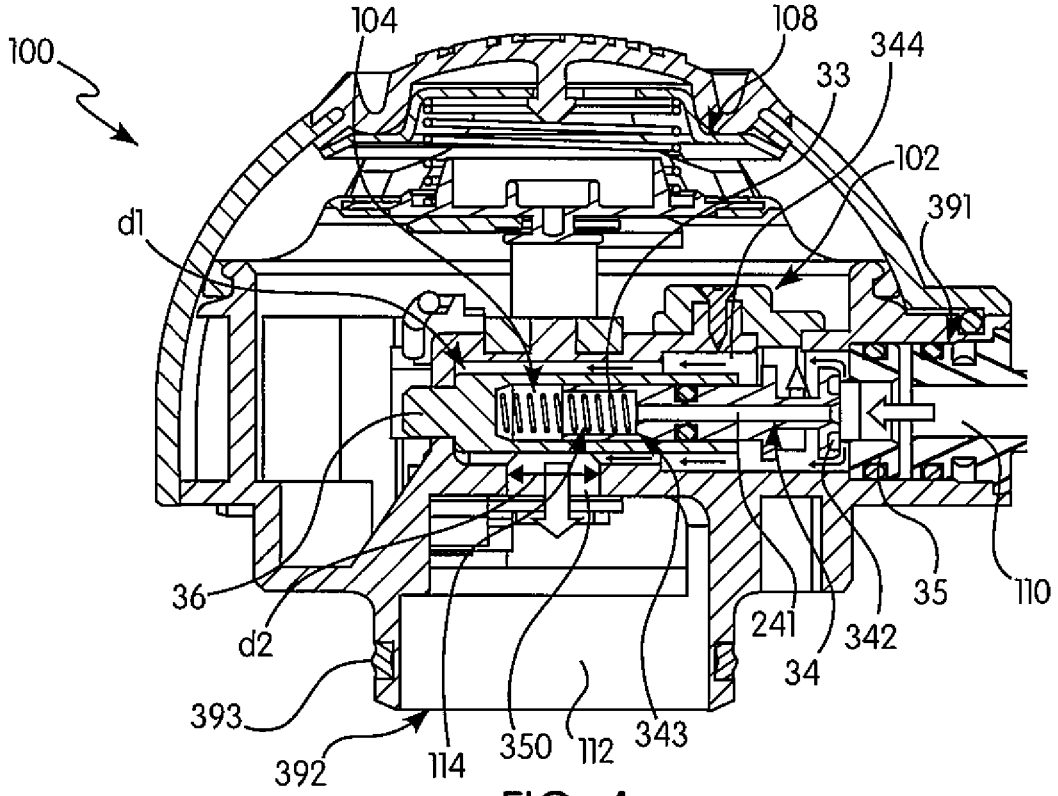
FIG. 4 is a schematic view of air flow in one embodiment or aspect of a pressure regulator assembly according to the principles of the present invention.

In one preferred and non-limiting embodiment or aspect, and as shown in FIGS. 3 and 4, the pressure regulator assembly 100 includes an air inlet 391 coupled to an air source and an air outlet 392 coupled to a destination device (e.g., a breathing mask or helmet). Further, the pressure regulator assembly 100 includes a housing 39 that defines an inlet chamber 110 in fluid communication with the air inlet 391, and an outlet chamber 112 in fluid communication with the air outlet 392. The valve assembly 102 is operatively positioned between the inlet chamber 110 and the outlet chamber 112, and, as discussed above, the valve assembly includes a piston 34, a sealing member (or element) 35, and a cylinder 36 (with the cavity 104 between the end 106 of the cylinder 36 and the second end 343 of the piston 34). The sealing member 35 is positioned between the piston 34 and the inlet chamber 110, adjacent to the first end 342 of the piston 34. When the piston 34 is driven to engage the sealing member 35 (such as by a biasing element 33), there exists no fluid communication or passage between the inlet chamber 110 and the outlet chamber 112, and when the piston 34 moves away or is disengaged from the sealing element 35, fluid (e.g., air) within the inlet chamber 110 may flow into the outlet chamber 112, thereby forming a fluid passage between the two chambers 110, 112. In particular when the first end 342 of the piston 34 engages the sealing member 35, air is prevented from exiting the inlet chamber 110, and when the first end 342 of the piston 34 is disengaged from the sealing member 35, air is capable of exiting the inlet chamber 110 (and, thus, flows through the valve assembly 102 and into the outlet chamber 112).

As discussed above, and in order to facilitate the counteraction of the acting force of the fluid pressure within the cylinder 36 on the piston 34 and at least part of the acting force of the fluid pressure in the inlet chamber 110 on the piston 34, the conduit (or through-hole) 241 provides fluid communication between the first end 342 and the second end 343 of the piston 34, so as to allow the passage of air within the inlet chamber 110 to the cavity 104. Since the air pressure on both ends 342, 343 of the piston 34 are substantially the same, the acting forces generated by fluid/air pressure at the front and rear sides of the piston 34 counteract each other, and the air pressure experienced by the piston 34 is substantially zero, thereby further reducing the movement resistance of the piston 34. In this manner, the valve assembly 102 of the pressure regulator assembly 100 is balanced.

As discussed above, and with continued reference to FIGS. 3 and 4, the pressure regulator assembly 100 includes driving assembly 108 coupled to or operationally engaged with the valve assembly 102. The driving assembly 108 is configured or operable to drive the piston 34 to engage and/or disengage the sealing member 35 in response to pressure change in the outlet chamber 112. As discussed, and in one preferred and non-limiting embodiment or aspect, the driving assembly 108 includes the diaphragm 31, the first lever 32*a*, and the second lever 32*b* coupled to or operationally connected with the piston 34. In addition, and in one preferred and non-limiting embodiment or aspect, the valve assembly 102 includes the biasing element 33 (which may be in the form of a reset spring) disposed or positioned within the cavity 104 of the cylinder 36 and configured to bias or urge the piston 34 towards and against the sealing member 35. The second end 343 of the piston 34 may include a recess 114 for receiving at least part of the biasing element 33 so as to enhance the stability of the biasing element 33 between the cylinder 36 and the second end 343 of the piston 34.

In one preferred and non-limiting embodiment or aspect, and in order to facilitate the connection of the pressure regulator assembly 100 and the destination device, e.g., a breathing mask or helmet, a sealing ring 393 is positioned at or near the end of the air outlet 392, which will allow the pressure regulator assembly 100 to be flexible and rotatable, while still providing an effective seal, thereby enhancing the operational benefits to the users.

One preferred and non-limiting embodiment or aspect of operation of the pressure regulator assembly 100 is as follows:

Stage 1: When the pressure in the outlet chamber 112 becomes lower (e.g., decreased pressure caused by inhaling of the user), the diaphragm 31 will move downward to apply a downward force to the first lever 32*a* and, through a linkage, the second lever 32*b* to drive the piston 34 away from the sealing member 35, thereby disengaging the first end 342 of the piston 34 and the sealing member 35.

Stage 2: When the pressure in the outlet chamber 112 becomes higher (e.g., the air enters into the outlet chamber 112 and raises the pressure in the outlet chamber 112), the diaphragm 31 will move upward to thereby remove the force applied to the piston 34 via the levers 32*a*, 32*b*. Under the action of the biasing element 33, the first end 342 of the piston 34 returns to the initial, engaged position, i.e., the first lever 32*a* will be linked to the second lever 32*b*, driving the first lever 32*a* and the second lever 32*b* to resume the initial state, further causing the piston 34 to engage the sealing member 35.

FIG. 4 illustrates a schematic diagram depicting the air flow of the pressure regulator assembly 100 and valve assembly 102 according to certain preferred and non-limiting embodiments or aspects of the present invention. In one preferred and non-limiting embodiment or aspect, the valve assembly 102 further includes a support portion for supporting the cylinder 36, so as to define, with an exterior surface of the cylinder 36, a passage 344 at least partially surrounding the cylinder 36 and an exterior surface of the first end 342 of the piston 34. Accordingly, when the piston 34 moves away from the sealing element 35, air/fluid enters into the inlet chamber 110 from the air inlet 391 and enters the outlet chamber 112 via the passage 344, finally reaching the air outlet 392. Due to existence of the passage 344, the air/fluid can rapidly reach the outlet chamber 112, reducing blockage during the air/fluid flow process. In addition, in order to further enhance the effect of removing chatter, the width of the passage 344 is in the range of about 0.7 mm to about 1.2 mm (i.e., distance d1 in FIG. 4), while the diameter of an inlet portion 350 of the outlet chamber 112 is in the range of about 8.8 mm to about 9.6 mm (i.e., distance d2 in FIG. 4). By setting d1 and d2 in these ranges, the breathing resistance in the breathing mask or helmet, and the chatter induced by breathing, are optimized, which not only keeps positive pressure within the breathing mask or helmet, but also minimizes or removes the chatter induced by breathing. In one preferred and non-limiting embodiment or aspect, d1 is about 1.0 mm and d2 is about 9.0 mm.

In order to further optimize (i.e., minimize or remove) the chatter induced when breathing, the inlet chamber 110 extends in a first (fluid-in) direction and the outlet chamber 112 extends in a second (fluid-out) direction. In one preferred and non-limiting embodiment or aspect, the first direction is angled with respect to the second direction. In another preferred and non-limiting embodiment or aspect, the angle is about 90°, i.e., the first direction is substantially perpendicular to the second direction.

Figure 5:
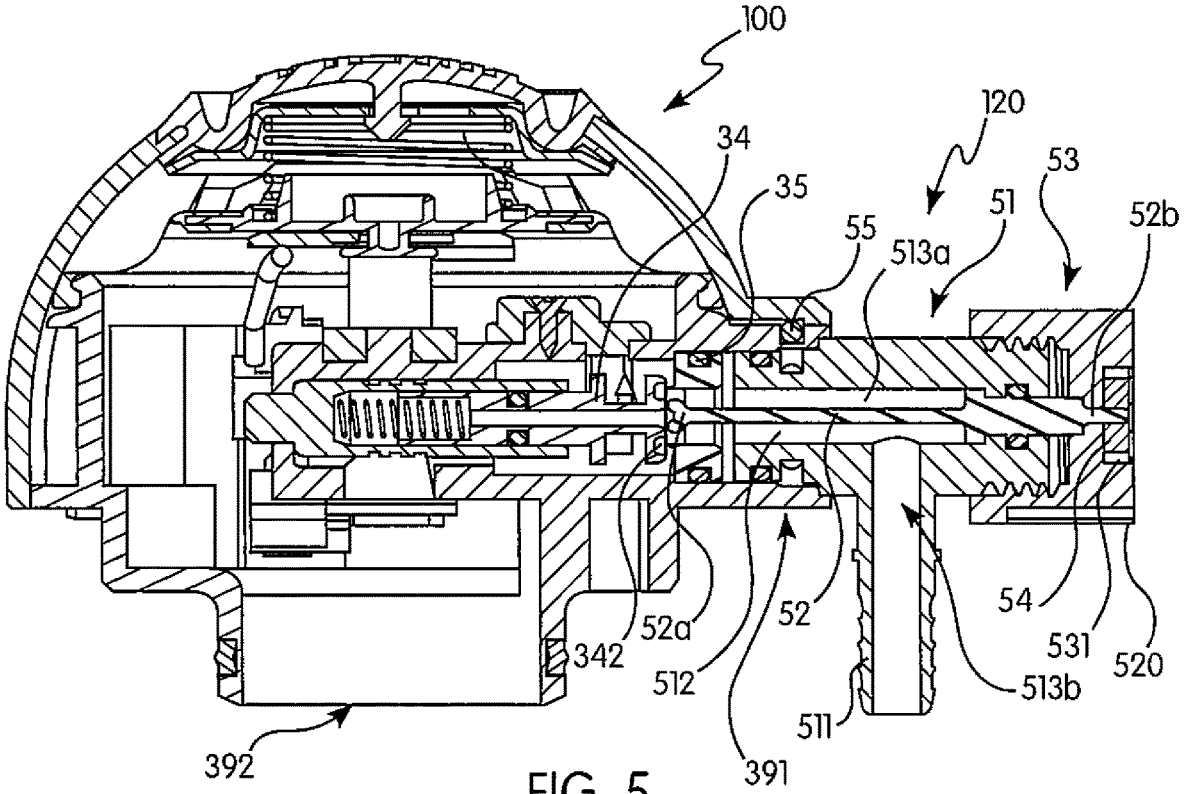
FIG. 5 is a schematic view of one embodiment or aspect of a bypass assembly according to the principles of the present invention for use in connection with a pressure regulator assembly.

In one preferred and non-limiting embodiment or aspect, and as illustrated in FIG. 5, the present invention is directed to a bypass assembly 120 for use in connection with a pressure regulator assembly, such as the pressure regulator assembly 100 according to the present invention. This bypass assembly 120 is removably connectable or attachable to a suitable pressure regulator assembly, such as the pressure regulator assembly 100, and configured to disengage a piston of a valve assembly, such as the piston 34 of the valve assembly 102 according to the present invention, to thereby allow or facilitate air flow through the valve assembly and into an outlet chamber or outlet, such as the outlet chamber 112 and air outlet 392 according to the present invention. In one preferred and non-limiting embodiment or aspect, the bypass assembly 120 is useful in connection with a valve assembly of a positive pressure-type air pressure regulator.

In one preferred and non-limiting embodiment or aspect, and as illustrated in FIG. 5, the bypass assembly 120 is removably coupled to an inlet of the pressure regulator assembly, such as the air inlet 391 of the pressure regulator assembly 100 of FIGS. 2-4.

In the present embodiment, a bypass assembly 120 is coupled to an inlet of the pressure regulator assembly 100 via a fixing piece (e.g., a U-shaped clip 55 or other fixing component), and the bypass assembly 120 includes a bypass housing 51 defining a bypass inlet 511, a bypass outlet 512, and a fluid passage 513 between the bypass inlet 511 and the bypass outlet 512. The fluid passage 513 is formed with a first passage portion 513*a* and a second passage portion 513*b* (which, in one preferred and non-limiting embodiment or aspect, is angled with respect to the first passage portion 513*a*, e.g., a substantially 90° angle). In addition, the bypass assembly 120 includes a push rod 52 positioned in the fluid passage 513, the push rod 52 including a first end 52*a* of the push rod 52 positioned substantially adjacent a piston (e.g., the piston 34). In particular, the first end 52*a* of the push rod 52 is configured to contact a first end of the piston (e.g., the first end 342 of the piston 34) and disengage the piston (e.g., the piston 34) from a sealing member (e.g., sealing member 25), such that air in the fluid passage 513 flows through the valve assembly (e.g., the valve assembly 102) and into the outlet chamber or outlet (e.g., the outlet chamber 112 or outlet 392).

In one preferred and non-limiting embodiment or aspect, and with continued reference to FIG. 5, the bypass assembly 120 includes a rotatable member 53 (e.g., a handwheel) operatively or rotatably connected or coupled to the bypass housing 51. When the rotatable member 53 is rotated in a first direction (e.g., a counter-clockwise direction), the push rod 52 is urged toward and into contact with the piston (e.g., the piston 34) to thereby disengage the piston (e.g., the piston 34) from the sealing member (e.g., the sealing member 25), and when the rotatable member 53 is rotated in a second direction (e.g., a clockwise direction), the push rod 52 is urged away from and out of contact with the piston (e.g., the piston 34) to thereby permit reengagement of the piston (e.g., the piston 34) with the sealing member (e.g., the sealing member 25). In one preferred and non-limiting embodiment or aspect, a recess 531 extends into the body of the rotatable member 53, and a cover 54 is positioned at least partially within the recess 531 and is engaged with the second end 52*b* of the push rod 52. In operation, when the user rotates the rotatable member 53 in the first direction (e.g., a counter-clockwise direction), the lateral movement of the rotatable member 53 and the cover 54, will drive or urge the push rod 52 to move to the left, causing the piston 34 to disengage the sealing member 25, thereby opening the pressure regulator assembly 100 and producing a constant air flow. Further, the rotatable member 53 provides the user with the ability to adjust (or tune) the amount of air flow based upon the rotation of the rotatable member 53 in the first direction or second direction. In one preferred and non-limiting embodiment or aspect, one or more anti-slip teeth 520 (or ridges) may be provided on the rotatable member 53 to increase the friction force, such that the user can easily open it even with gloves on.

The bypass assembly 120 facilitates the provision of constant and adjustable air flow (through the rotation of the rotatable member 53), which will flush a face-shield of a breathing mask or helmet and remove or eliminate fog on the face-shield. Further, the bypass assembly provides an emergency air source if a valve assembly (e.g., the valve assembly 102) malfunctions (e.g., cannot be opened), thereby ensuring that the user can maintain normal breathing. Further, and as discussed, the user can quickly couple and/or decouple the bypass assembly 120 and the pressure regulator assembly (e.g., the pressure regulator assembly 100) with his or her hands using a fixing piece (e.g., the U-shaped clip 55 or other fixing component).

Based on the structure of the present invention, and in one preferred and non-limiting embodiment or aspect, many of components of the pressure regulator assembly 100 may be manufactured in a molding (e.g., an injection molding) process, which provides a simplified manufacturing process, reduces manufacturing costs, and reduces product weight.

Figure 6:
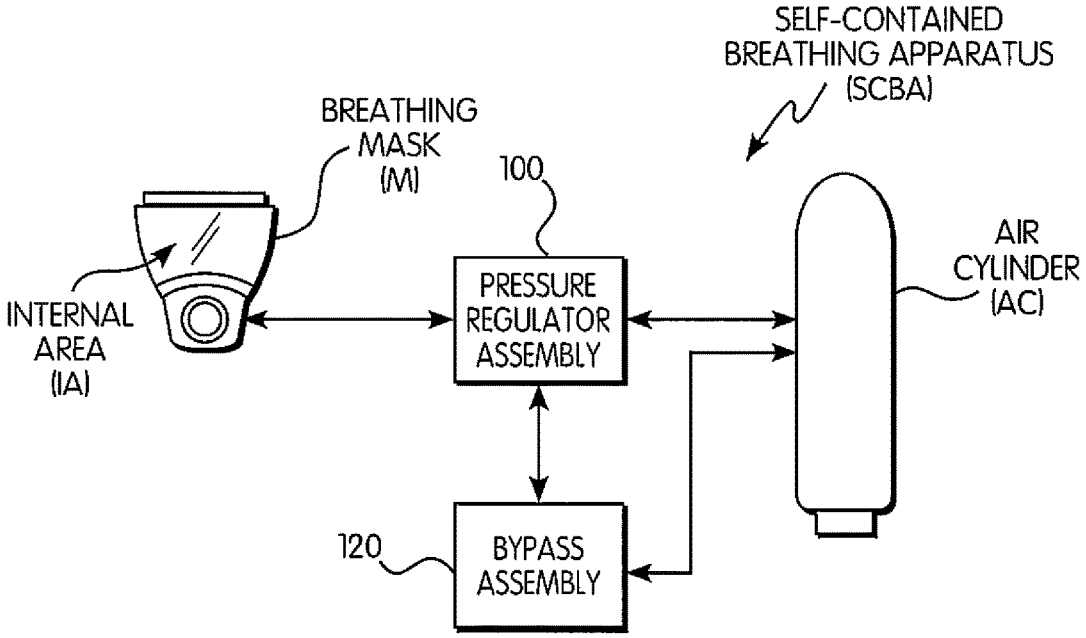
FIG. 6 is a schematic view of one embodiment or aspect of a self-contained breathing apparatus according to the principles of the present invention.

As discussed above, and as illustrated in schematic form in FIG. 6, the pressure regulator assembly 100 and/or the bypass assembly 120 may be used in connection with a self-contained breathing apparatus (SCBA). In particular, and in this embodiment, the self-contained breathing apparatus (SCBA) includes: at least one air cylinder (AC) configured to deliver regulated air through an air hose (not shown); and a breathing mask or helmet (M) configured to be worn by a user. The breathing mask or helmet (M) is engaged with and/or used in connection with a pressure regulator assembly, which is configured to deliver air from the air hose to an internal area (IA) of the breathing mask or helmet (M). Accordingly, the pressure regulator assembly that is coupled to the breathing mask or helmet (M) may be the above-discussed pressure regulator assembly 100. Further, the above-discussed bypass assembly 120 may be used in connection with an existing pressure regulator assembly or the above-discussed pressure regulator assembly 100.

In this manner, provided is an improved pressure regulator assembly 100 and bypass assembly 120 for a pressure regulator assembly for use in connection with a self-contained breathing apparatus (SCBA).

Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the appended claims. For example, it is to be understood that the present invention contemplates that, to the extent possible, one or more features of any embodiment or aspect can be combined with one or more features of any other embodiment or aspect.

What is claimed is:

1. A pressure regulator assembly, comprising:

a housing defining an inlet chamber in fluid communication with an outlet chamber;

a valve assembly positioned between the inlet chamber and the outlet chamber, the valve assembly comprising:

(i) a piston having a body with a first end and a second end;

(ii) a cylinder configured to receive the second end of the piston, the cylinder having a closed end cap and defining an enclosed cavity between the closed end cap and the piston;

(iii) at least one biasing element positioned in the enclosed cavity and having a first end engaged with the closed end cap and a second end engaged with the second end of the piston, the at least one biasing element configured to urge the first end of the piston into engagement with a sealing member;

(iv) the sealing member configured for engagement by the first end of the piston, wherein, when the first end of the piston engages the sealing member, air is prevented from exiting the inlet chamber, and when the first end of the piston is disengaged from the sealing member, the air is capable of exiting the inlet chamber;

(v) a conduit extending through the body of the piston and facilitating fluid communication between the inlet chamber and the enclosed cavity;

(vi) a driving assembly coupled to the valve assembly and configured to facilitate the engagement and disengagement of the piston in response to a change of pressure in the outlet chamber; and (vii) a bypass assembly configured to be removably attached to the pressure regulator assembly and configured to disengage the first end of the piston from the sealing member and facilitate a flow of the air through the valve assembly and into the outlet chamber, wherein the bypass assembly comprises:

a bypass housing defining a bypass inlet, a bypass outlet, and a fluid passage extending between the bypass inlet and the bypass outlet; and a push rod having a first end configured to contact the first end of the piston and disengage the first end of the piston from the sealing member, such that the air in the fluid passage of the bypass housing flows through the valve assembly and into the outlet chamber.

2. The pressure regulator assembly of claim 1, wherein the at least one biasing element comprises at least one spring.

3. The pressure regulator assembly of claim 1, wherein the second end of the piston comprises a recess configured to receive at least a portion of the at least one biasing element.

4. The pressure regulator assembly of claim 1, wherein the valve assembly further comprises at least one passage at least partially enclosing the cylinder and an external surface of the first end of the piston to facilitate fluid communication between the inlet chamber and the outlet chamber when the first end of the piston is disengaged from the sealing member.

5. The pressure regulator assembly of claim 4, wherein a width of the passage is in a range of 0.7 mm to 1.2 mm, and a diameter of an inlet portion of the outlet chamber is in a range of 8.8 mm to 9.6 mm.

6. The pressure regulator assembly of claim 5, wherein the width of the passage is 1.0 mm and the diameter of the inlet portion of the outlet chamber is 9.0 mm.

7. The pressure regulator assembly of claim 1, wherein the inlet chamber extends in a first direction and the outlet chamber extends in a second direction, wherein the first direction is angled with respect to the second direction.

8. The pressure regulator assembly of claim 7, wherein the angle is about 90°.

9. The pressure regulator assembly of claim 1, further comprising a rotatable member rotatably connected to the bypass housing, wherein when the rotatable member is rotated in a first direction, the push rod is urged toward and in contact with the first end of the piston to thereby disengage the first end of the piston and the sealing member, and wherein the rotatable member is rotated in a second direction, the push rod is urged away from and out of contact with the first end of the piston to thereby permit reengagement of the first end of the piston with the sealing member.

10. The pressure regulator assembly of claim 9, wherein the rotatable member comprises:

a recess extending into a body of the rotatable member; and a cover positioned at least partially within the recess and engaged with a second end of the push rod, such that when the rotatable member is rotated in the first direction, the cover, and thereby the push rod, is urged toward and into contact with the first end of the piston to thereby disengage the first end of the piston and the sealing member.

11. The pressure regulator assembly of claim 1, wherein the bypass assembly is adjustable to thereby adjust an amount of the flow of the air through the bypass assembly, through the valve assembly, and into the outlet chamber.

12. A bypass assembly for a pressure regulator assembly having:

(i) a valve assembly positioned between an inlet chamber and an outlet chamber and including: a piston having a body with a first end and a second end; a cylinder configured to receive the second end of the piston, the cylinder having a closed end cap and defining an enclosed cavity between the closed end cap and the piston; at least one biasing element positioned in the enclosed cavity and having a first end engaged with the closed end cap and a second end engaged with the second end of the piston, the at least one biasing element configured to urge the first end of the piston into engagement with a sealing member; and the sealing member configured for engagement by the first end of the piston, wherein, when the first end of the piston engages the sealing member, air is prevented from exiting the inlet chamber, and when the first end of the piston is disengaged from the sealing member, the air is capable of exiting the inlet chamber; and (ii) a driving assembly coupled to the valve assembly and configured to facilitate the engagement and disengagement of the piston responsive to a change of pressure in the outlet chamber, the bypass assembly configured to be removably attached to the pressure regulator assembly and configured to disengage the first end of the piston from the sealing member and facilitate a flow of the air through the valve assembly and into the outlet chamber, wherein the bypass assembly comprises:

a bypass housing defining a bypass inlet, a bypass outlet, and a fluid passage extending between the bypass inlet and the bypass outlet; and a push rod having a first end configured to contact the first end of the piston and disengage the first end of the piston from the sealing member, such that the air in the fluid passage of the bypass housing flows through the valve assembly and into the outlet chamber.

13. The bypass assembly of claim 12, further comprising a rotatable member rotatably connected to the bypass housing, wherein when the rotatable member is rotated in a first direction, the push rod is urged toward and in contact with the first end of the piston to thereby disengage the first end of the piston and the sealing member, and wherein when the rotatable member is rotated in a second direction, the push rod is urged away from and out of contact with the first end of the piston to thereby permit reengagement of the first end of the piston with the sealing member.

14. The bypass assembly of claim 13, wherein the rotatable member comprises:

a recess extending into a body of the rotatable member; and a cover positioned at least partially within the recess and engaged with a second end of the push rod, such that when the rotatable member is rotated in the first direction, the cover, and thereby the push rod, is urged toward and into contact with the first end of the piston to thereby disengage the first end of the piston and the sealing member.

15. The bypass assembly of claim 12, wherein the pressure regulator assembly further comprises:

a conduit extending through the body of the piston and facilitating fluid communication between the inlet chamber and the enclosed cavity.

16. A self-contained breathing apparatus, comprising:

at least one air cylinder configured to deliver regulated air through an air hose; and a breathing mask configured to be worn by a user, the breathing mask having a pressure regulator assembly configured to deliver the air from the air hose to an internal area of the mask, wherein the pressure regulator assembly comprises:

(a) a housing defining an inlet chamber in fluid communication with an outlet chamber;

(b) a valve assembly positioned between the inlet chamber and the outlet chamber, the valve assembly comprising:

(i) a piston having a body with a first end and a second end;

(ii) a cylinder configured to receive the second end of the piston, the cylinder having a closed end cap and defining an enclosed cavity between the closed end cap and the piston;

(iii) at least one biasing element positioned in the enclosed cavity and having a first end engaged with the closed end cap and a second end engaged with the second end of the piston, the at least one biasing element configured to urge the first end of the piston into engagement with a sealing member;

(iv) the sealing member configured for engagement by the first end of the piston, wherein, when the first end of the piston engages the sealing member, air is prevented from exiting the inlet chamber, and when the first end of the piston is disengaged from the sealing member, the air is capable of exiting the inlet chamber; and (v) a conduit extending through the body of the piston and facilitating fluid communication between the inlet chamber and the enclosed cavity;

(c) a driving assembly coupled to the valve assembly and configured to facilitate the engagement and disengagement of the piston responsive to a change of pressure in the outlet chamber; and (d) a bypass assembly configured to be removably attached to the pressure regulator assembly and configured to disengage the first end of the piston from the sealing member and facilitate a flow of the air through the valve assembly and into the outlet chamber, wherein the bypass assembly comprises:

a bypass housing defining a bypass inlet, a bypass outlet, and a fluid passage extending between the bypass inlet and the bypass outlet; and a push rod having a first end configured to contact the first end of the piston and disengage the first end of the piston from the sealing member, such that the air in the fluid passage of the bypass housing flows through the valve assembly and into the outlet chamber.

* * * * *